United States Patent [19]

Adams et al.

[11] 4,188,416

[45] Feb. 12, 1980

[54] SPRAYABLE MATERIAL FOR REPAIRING BASE PLATES OF INGOT MOLDS

[75] Inventors: Paul G. Adams, Birmingham, Ala.; Kenneth A. Gebler, Munster, Ind.

[73] Assignee: Nalco Chemical Company, Oak Brook, Ill.

[21] Appl. No.: 966,679

[22] Filed: Dec. 5, 1978

[51] Int. Cl.[2] ..... B26D 7/38

[52] U.S. Cl. ..... 427/135; 164/72; 106/38.27

[58] Field of Search ..... 427/135; 106/38.27; 164/72

[56] References Cited

U.S. PATENT DOCUMENTS

| | | | |
|---|---|---|---|
| 2,995,453 | 8/1961 | Noble | 106/38.27 |
| 3,184,815 | 5/1965 | Reuter | 427/135 |
| 3,396,935 | 8/1968 | Snyder | 427/135 |
| 3,509,936 | 5/1970 | Kearfott | 164/72 |
| 3,674,518 | 7/1972 | Vuaroqueaux | 164/72 |
| 3,885,062 | 5/1975 | Bombola | 106/38.27 |

FOREIGN PATENT DOCUMENTS

| | | | |
|---|---|---|---|
| 764376 | 8/1967 | Canada | 427/135 |

*Primary Examiner*—Sam Silverberg

*Attorney, Agent, or Firm*—John G. Premo; Robert A. Miller

[57] ABSTRACT

The base plates or stools of ingot molds used in the casting and teeming of molten steel can be repaired by spraying onto the ingot mold base plate from 2–5 gallons of a composition comprising:

| | | |
|---|---|---|
| Less than 20 mesh alumina-silicate refractory grain[1] | | 49.5% |
| Less than 200 mesh alumina silicate refractory grain[1] | | 11.56% |
| Less than 325 mesh $Al_2O_3$ | | 13.21% |
| Less than 325 mesh bentonite clay | | 1.75% |
| Binder - 75% phosphoric acid | 77.0% | |
| Alumina/trihydrate | 11.2% | |
| Powdered boric acid | 2.35% | |
| $H_2O$ | 9.45% | 11.99% |
| Water | | 11.99% |

[1]Contains approximately 47% as $Al_2O_3$

2 Claims, No Drawings

SPRAYABLE MATERIAL FOR REPAIRING BASE PLATES OF INGOT MOLDS

INTRODUCTION

All metal ingots are cast from molds. These molds rest on bases commonly known as stools. The stools are merely large, normally rectangular flat slabs of metal commonly made of cast iron which are used as support for the molds sides and also generally form the bottom portion of the mold. Various problems commonly occur in the use of these stools and particularly with respect to the surface of the mold stool which is contacted with molten metal.

First, the unprotected metal surface quickly erodes and pits in the presence of molten metal which are cascaded upon their surface. Large gouges in the base portions are produced due to the force and high temperature developed by the flowing molten metal which contacts the surface of the stool. Since many molds are generally approximately 5–10 feet in height, the metal must be poured from a height at least equal to that distance and quite often is poured from even greater heights. A considerable pressure head is thereby developed. Thus the hot molten metal easily gouges gaping depressions in the base members under such force and at a temperature of at least the liquefaction temperature of the molten metal. Moreover, the problem of creation of pits or gouges in the base portions of the molds, caused by the above factors is aggravated due to the fact that the molten metal, especially near the bottom of the mold, remains in its erosive hot liquid states for a considerable amount of time subsequent to pouring.

The molten metal upon solidification to an ingot thereby has a bottom form conforming to the undesirable eroded surface configuration of the stool or base member of the mold. Thus, a considerable amount of the ingot, when withdrawn from the mold and subsequently process into slabs or blooms, is lost through a cropping of the irregularly formed end of the slab. This, of course, is highly undesirable, since it results in undue loss of usable metal and increase in scrap, which must be subsequently reprocessed.

Another extremely serious and costly problem results after the ingot in the mold has solidified to a point where it can be removed from both the mold sides and its base platform member or stool. In many cases, if the surface of the stool is unprotected, or inadequately protected, and erosion occurs as described above, the ingot has a greater tendency to remain tightly adherent to the stool. Thus, after the mold sides are removed from around the ingot, which process can normally be efficiently achieved with a minimal film of coating selected from a variety of coating agents, the ingot must be forcibly removed from the stool. This is normally achieved by raising both ingot and adherent stool, and thrusting them against some other larger object whereby the ingot is jarred loose. In many cases the stool and ingot are merely dropped on the floor from some suitable height. In such a situation, the stool is often broken into two or more smaller pieces and cannot be subsequently reused in casting other ingots. Again, replacement cost of these stools is high, making this aspect of the overall casting process somewhat disadvantageous. The same problem exists with respect to big end up molds wherein sticking exists with respect to big end up molds wherein sticking of ingots particularly occurs at their base portion. New molds of this type are especially vulnerable to sticking due to their smooth surface unprotected by any layers of metal oxides or scale. A tight metal-to-metal bond between mold bottoms and ingots then occurs.

Cracking of molds and particularly their base portions due to the above discussed rough handling occasioned by "stickers" between the base portions and ingots is also enhanced by thermal shock during ingot formation. Unprotected or inadequately protected bottom surfaces of mold are especially susceptible to such destructive shock.

Many solutions to alleviating the above described problems in connection with the erosion of base members of ingot molds have been proposed by the prior art. A number of refractory coatings have been suggested but these are not entirely satisfactory.

While refractory stool patches have met with commercial success, these patches are not altogether satisfactory in that after several pourings they may tend to crack or chip allowing molten metal to get into the inclusion. The same is also true with refractory inserts. After the insert has worn, the molten metal flows below or through cracks in the insert and causes metallic inclusions in the ingot which necessitate the expensive operation known as "butt cropping."

If it were possible to repair a stool quickly and inexpensively whereby improved life could be achieved, a substantial advance to the art could be achieved.

OBJECTS

It is therefore an object of this invention to provide to the art a sprayable, pumpable, stool repair refractory.

Another object of this invention is to provide a composition which when applied to stools which may or may not contain refractory patches or inserts, will eliminate metallic inclusions in ingots formed utilizing the thus treated stool.

Other objects will appear hereinafter.

THE INVENTION

The composition of this invention is as follows:

| | | |
|---|---|---|
| Less than 20 mesh alumina-silicate refractory grain[1] | | 49.5% |
| Less than 200 mesh alumina silicate refractory grain[1] | | 11.56% |
| Less than 325 mesh $Al_2O_3$ | | 13.21% |
| Less than 325 mesh bentonite clay | | 1.75% |
| Binder - 75% phosphoric acid | 77.0% | |
| Alumina/trihydrate | 11.2% | |
| Powdered boric acid | 2.35% | |
| $H_2O$ | 9.45% | 11.99% |
| Water | | 11.99% |

[1]Contains approximately 47% as $Al_2O_3$

The alumina-silicate material of this invention should contain roughly 47% of its weight as $Al_2O_3$. Approximately 50% of the composition is composed of material having a size not greater than 20 mesh. Approximately 11.5% of the composition is of the same material having a mesh size not greater than 200 mesh.

The alumina present in this composition (13.21%) is preferably present in extremely small particle size, preferably not greater than 325 mesh. The clay utilized in this invention which comprises approximately 1.75% by weight of the composition, is preferably a bentonite material although other alumina containing clays can be utilized. Again, particle size is important with the clay being of small particle size preferably not greater than 325 mesh. The refractory binder utilized in this invention is an alumina-phosphoric acid type material. While percentages can vary from what is given above, it is important that the binder of the refractory materials present in the composition and to allow for the hardening and curing of the material when sprayed upon a warm ingot mold stool.

USE OF THE COMPOSITION OF THE INVENTION

The composition of the instant invention is fluid and may be pumped utilizing a diaphram pump through a small i.d. hose. One of the criteria of the composition of this invention is that it must be pumpable though a 1" e.d. hose having a length of 75 feet. This is critical in the fact that the hose must be able to be adequately handled by one individual.

In a field trial of the instant invention, ingot molds which had been patched using a high alumina refractory were repaired by spraying onto the stool 2–5 gallons of the composition described above. Spraying was accomplished utilizing a diaphram pump through a 1" hose having a length of 75 feet. The material flowed onto the stool easily, was self-leveling and adequately filled cracks and broken edges in this stool patch. Residual heat contained in the stool was sufficient to dry and cure the material to provide a strong crack free patch.

The composition of this invention may also be used on stools which have placed therein refractory inserts. In this case, the composition of the instant invention fills the edges between the refractory insert and the stool thus preventing molten metal from flowing between the stool and the insert.

The composition and method of this invention substantially reduced the metallic inclusions in the ingot being formed using stools so treated.

We claim:

1. A process for repairing ingot mold stools which comprises:

A. Spraying onto the stool a composition comprising:
  (1) 49.5%—20 mesh alumina-silicate refractory grain;
  (2) 11.56%—200 mesh alumina-silicate refractory grain;
  (3) 13.21%—325 mesh $Al_2O_3$;
  (4) 1.75%—325 mesh bentonite clay;
  (5) 11.99% of a binder having a composition comprising:
    a. 75% phosphoric acid—77.0%;
    b. alumina/trihydrate—11.2%;
    c. powdered boric acid—2.35%; and,
    d. water—9.45%;
  (6) 11.99%—water; said composition being fluid and sprayable through a 1 inch hose having a length of 75 feet;

B. Allowing said composition to cure utilizing the residual heat in said ingot mold stool; and, C. Recovering a repaired ingot mold stool.

2. A sprayable refractory composition comprising:

A. 49.5%—20 mesh alumina-silicate refractory grain;
B. 11.56%—200 mesh alumina-silicate refractory grain;
C. 13.21; %—325 mesh $Al_2O_3$;
D. 1.75%—325 mesh bentonite clay;
E. 11.99% of a binder having a composition comprising:
  (1) 75% phosphoric acid—77.0%;
  (2) alumina/trihydrate—11.2%;
  (3) powdered boric acid—2.35%; and,
  (4) water—9.45%;
F. 11.99%—water;

said composition being fluid and sprayable through a 1 inch hose having a length of 75 feet.

* * * * *